United States Patent [19]

Woodard

[11] Patent Number: 4,862,507

[45] Date of Patent: Aug. 29, 1989

[54] MICROPHONE ACOUSTICAL POLAR PATTERN CONVERTER

[75] Inventor: Alan P. Woodard, Chicago, Ill.

[73] Assignee: Shure Brothers, Inc., Evanston, Ill.

[21] Appl. No.: 3,721

[22] Filed: Jan. 16, 1987

[51] Int. Cl.[4] ..... H04R 1/20

[52] U.S. Cl. ..... 381/155; 381/154; 381/159; 381/168

[58] Field of Search ..... 381/153–155, 381/158, 159, 168

[56] References Cited

U.S. PATENT DOCUMENTS

| | | | |
|---|---|---|---|
| 3,536,862 | 10/1970 | Weingartner | 381/155 |
| 3,588,382 | 6/1971 | Reedyk . | |
| 3,657,490 | 4/1972 | Scheiber | 381/155 |
| 3,778,561 | 12/1973 | Reedyk . | |
| 4,078,155 | 3/1978 | Botros et al. . | |
| 4,198,705 | 4/1980 | Massa . | |
| 4,264,790 | 4/1981 | Zlevor | 381/155 |
| 4,340,787 | 6/1982 | Görike | 381/155 |
| 4,421,957 | 12/1983 | Wallace, Jr. | 381/155 |
| 4,489,442 | 12/1984 | Anderson et al. . | |
| 4,694,499 | 9/1987 | Bartlett | 381/155 |

OTHER PUBLICATIONS

"Directional Transducers" by G. M. Sessler and J. E. West, Bell Telephone Laboratories, Inc., Murray Hill, N.J., 3/71.

"Providing Foldback with Out-of-Phase Loudspeakers" by Edward S. Jones, Electronic Media Department, Brigham Young University, Provo, Utah, 5/70.

Shure Brothers Inc. SM 98 Brochure, 1/85.

*Primary Examiner*—Donald J. Yusko

*Assistant Examiner*—Tyrone Queen

*Attorney, Agent, or Firm*—Allegretti & Witcoff, Ltd.

[57] ABSTRACT

A microphone acoustical polar pattern converter conveniently converts the acoustical polar pattern of a microphone from cardioid to supercardioid and back at will. The converter includes primarily a body of a tubular body portion fitted forward of the microphone head. Most preferably, the body is formed of open pore plastic, with a pore size of 70 microns.

4 Claims, 3 Drawing Sheets

MICROPHONE ACOUSTICAL POLAR PATTERN CONVERTER

BACKGROUND OF INVENTION

This invention relates to directional acoustic microphones.

As is well-known in electroacoustics, directional properties are usually imparted to microphones by subtracting the sound pressure at one point from the sound pressure at an adjacent point, ordinarily from ⅛" to 1" away. Consider a tube, 1" long, with a vibratile diaphragm in the middle. The motion of the

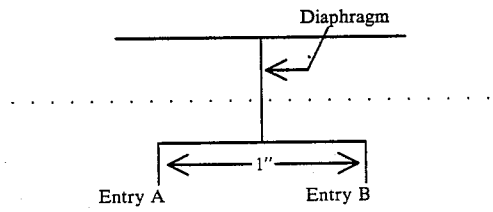

diaphragm will be proportional to the difference in sound pressure between entries A and B. There will be a time difference of 0.077 milliseconds from entries A and B for sounds originating at the left or right due to the velocity of sound. This is the maximum time difference for this construction and, hence, maximum output. Sounds originating in the plane of the diaphragm will arrive at exactly the same time and will produce no output. There is, of course, an additional delay of 0.0385 milliseconds inside the microphone (from entry A or B to the diaphragm), but this delay is added to both sounds and disappears in the subtraction.

If we establish an axis through the center, call the right entry 180° and the left 0°, then the polar pattern from this microphone will have a zero at 90° and 270° and will have equal and maximum sensitivity at 0° and 180°. This pattern is termed bidirectional, and occurs whenever the internal time delay is equal on both sides of the diaphragm. It is used when sounds from the side are to be rejected.

If a cloth screen is placed over entry B, the right half of the tube is converted to a low-pass acoustic filter. Below the cutoff frequency, this filter introduces an additional time delay. If the filter introduces a delay of 0.077 milliseconds, then sounds approaching from the right (180° ) will experience the following delays in milliseconds as it proceeds to the diaphragm by two paths:

| | Entry A | Entry B |
|---|---|---|
| | .077 (tube length) | .077 (filter) |
| | .0385 (½ tube) | .0385 (½ tube) |
| Total | .1155 | .1155 |
| A−B (difference) = 0, and hence sounds from the right will produce no output. | | |
| For sounds approaching from the left (°): | | |
| | .0385 (½ tube) | .077 (tube length) |
| | | .077 (filter) |
| | | .0385 (½ tube) |
| Total | .0385 | .1925 |
| A −B (difference) = .154 msec. | | |
| For sounds approaching from 90° or 270°: | | |
| | .0385 (½ tube) | .077 (filter) |
| | | .0385 (½ tube) |
| Total | .0385 | .1155 |

-continued

| Entry A | Entry B |
|---|---|
| A−B difference = .077 msec. | |

This is ½ of the delay at 0°, and hence ½ the output.

This microphone will have a maximum output at 0°, ½ maximum at 90° or 270°, and zero at 180°. This polar pattern is called a cardioid and is produced when the external delay is equal to the difference in internal delay from each of the two entries to the diaphragm. This pattern is used when rejection of sounds from the back of the microphone is desired.

When an interfering sound is present at an angle between 90° and 180° (say 125° ), a pattern called the supercardioid may be used, which has a null response at that angle. This pattern is produced when the internal difference of delay is equal to 0.577 times the external delay.

The foregoing examples show how the polar pattern may be changed by changing the delay of the filter in the rear (B) entry. This is the variable normally used to design a microphone polar pattern for a specific application and is an element of construction; i.e., not adjustable from the outside. Also, this explanation has not dealt with features which make the response to various frequencies of sound have uniformity.

SUMMARY OF THE INVENTION

In the foregoing context, the object of the inventor was to increase the usefulness of a cardioid polar pattern microphone by providing facile modification of the cardioid polar pattern of the microphone to a supercardioid polar pattern.

Another object of the inventor was to accomplish the foregoing while maintaining the frequency response characteristic of the microphone along the principal axis.

Another object of the inventor was to accomplish the foregoing in a non-electronic apparatus which is relatively inexpensive, reliable, long lasting and easily used without major, intricate, or internal modification of the microphone.

Consistent with fulfilling these objects, the present invention includes, in a principal aspect, a microphone acoustical polar pattern converter. The converter functions by adding an acoustic filter and time delay to the front entry of the microphone, which decreases the overall internal time delay and generates the supercardioid pattern. Physically, this comprises an annular converter body alignable with the microphone principal axis in forward proximity of the front entry of the microphone element. Preferably, the body defines an empty central cavity forward of the microphone element, and has its annular wall formed of open-celled material such as porous plastic. The pores of the material function as multiple ports along the microphone axis, which transmit sound from exterior to the body through the body of the cavity, and then to the front entry of the microphone element. The converter, as described, preconditions sound entering the microphone, such that the acoustic polar pattern of the microphone and converter combination is supercardioid.

This and other aspects of the invention are more fully explained in a detailed description of a preferred embodiment, which follows.

BRIEF DESCRIPTION OF THE DRAWING

The accompanying drawing includes ten figures. These figures are as follows.

DETAILED DESCRIPTION OF THE PREFERRED EMBODIMENT

The following terms are used in describing the preferred embodiment of the invention:

(1) Microphone Element—An acoustic transducer that converts acoustical energy to electrical energy. Unless stated, the polar pattern of this element is unrestricted.

(2) Cardioid Polar Pattern—A polar pattern in which responsiveness drops approximately 6 dB (decibels) at 90° from the principal axis and drops to null at 180° from the principal axis.

(3) Supercardioid Polar Pattern—A polar pattern in which responsiveness drops approximately 8.7 dB at 90° from the principal axis and in which two nulls appear spaced from 180° from the principal axis.

(4) Nulls—Locations of substantially decreased responsiveness such that in comparison to principal axis responsiveness, the responsiveness is effectively null or zero.

(5) Open Pore Material—Material formed as by sintering to have surface pores and internal pores which are open to each other to form labyrinth paths through the material.

(6) Pore Size—Nominal diameter of pores which may vary in diameter above and below nominal.

Figure 1:
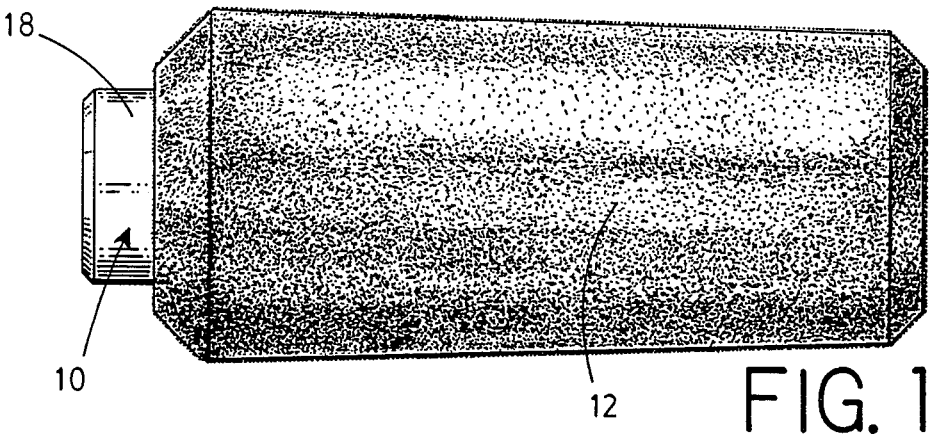
FIG. 1 is a side elevation view of a preferred embodiment of the invention, in location on a microphone.
Figure 2:
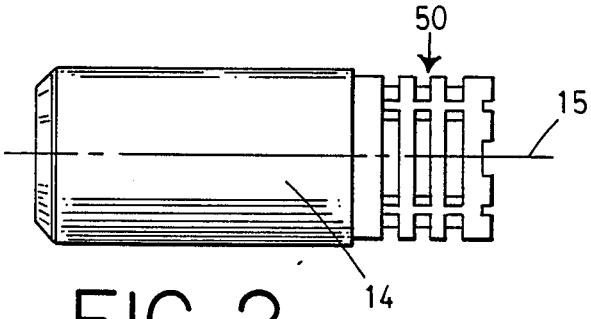
FIG. 2 is a side elevation view of the microphone of FIG. 1 alone.

Referring to FIG. 1, the preferred embodiment of the invention is an acoustical polar pattern converter (hereafter converter) 10 within a foam cover 12. Referring to FIG. 2, the converter 10 and cover 12 are fitted to a microphone, with the cover over the microphone head 14.

The microphone head has a principal axis 15, along which the head 14 points (to the right in FIG. 2). The head 14 includes internally an axially directed microphone element.

Figure 3:
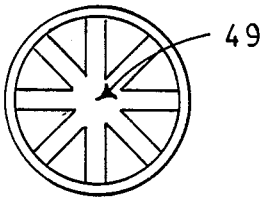
FIG. 3 is a front end view of the microphone of FIG. 1 alone.

The front entry of the microphone is shown by 49 of FIG. 3, and the rear entry is shown as circumferential openings 50.

Figure 4:
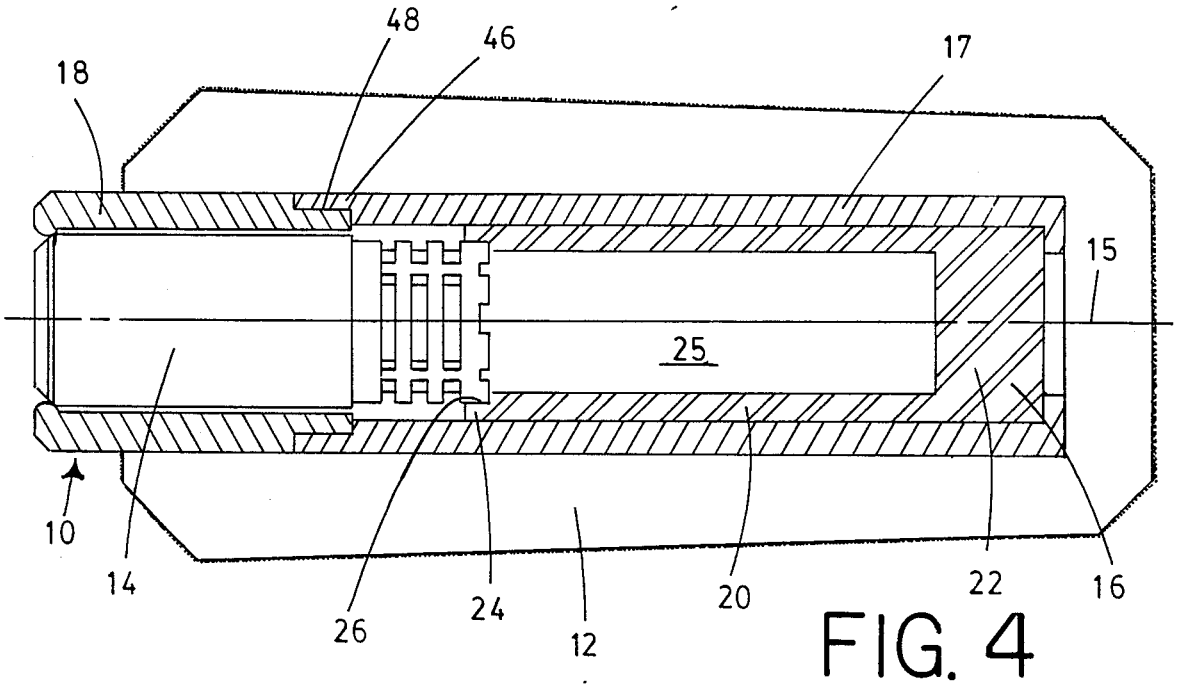
FIG. 4 is an enlarged, central cross section view of the subject of FIG. 1.

In FIG. 4, the converter 10 includes a body 16, a front support 17 and a rear support 18. The front and rear supports 17, 18 hold the body 16 to the microphone head 14.

The body 16 comprises three components: an annular or tubular body portion 20, an end cap 22, and a fitting portion 24. All three components are integrally formed of an open pore material, and preferably porous plastic. Most preferably, the body 16 is formed of high density polyethylene with a pore size of 70 microns. This most preferred material is available from Porex Technologies Corporation of Fairburn, Ga.

The annular body portion 20 has an annular wall with a uniform, radially measured, annular wall thickness. The annular wall encircles a central cavity 25 defined in the body portion 20 and closed remote from the microphone by the end cap 22.

The central cavity 25 is concentric with the principal axis of the microphone, as is the body portion 20, circular end cap 22, and fitting portion 24. The fitting portion 24 encircles and defines a fitting recess 26 which is open to the cavity 25. The fitting recess 26 has a diameter greater than cavity 25. The fitting portion 24 thus has an internal diameter such as to be press fittable on the tip of the microphone head 14.

Figure 7:
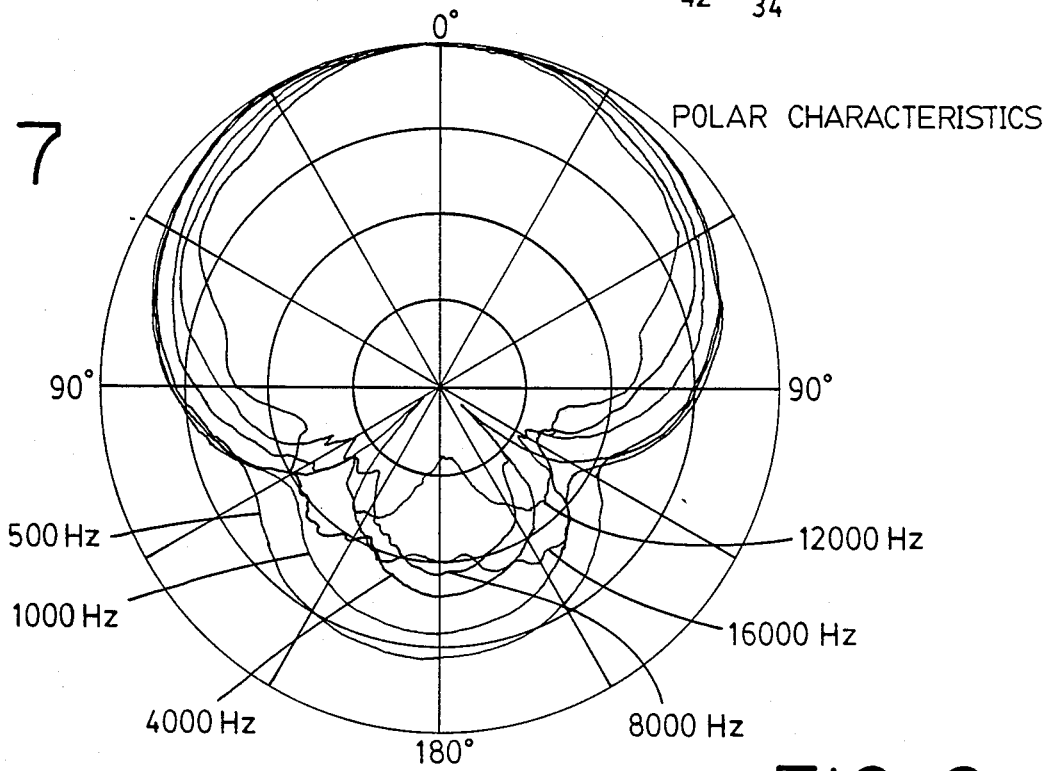
FIG. 7 is a chart of the polar characteristics of the preferred embodiment and microphone as in FIGS. 1 through 4.
Figure 8:
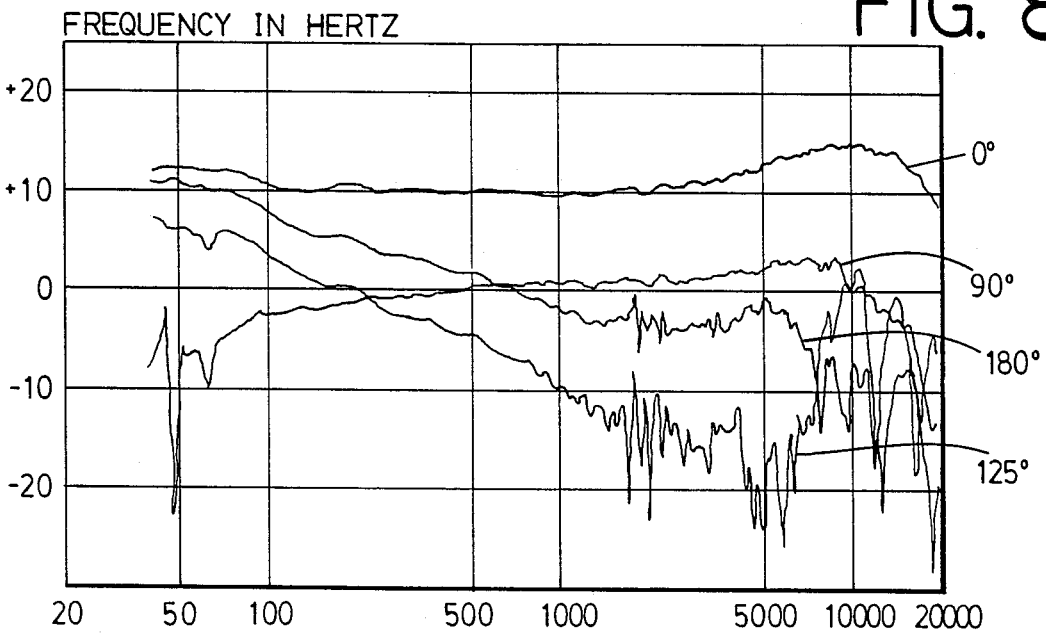
FIG. 8 is a chart of the frequency response of the preferred embodiment and microphone as in FIGS. 1 through 4.
Figure 9:
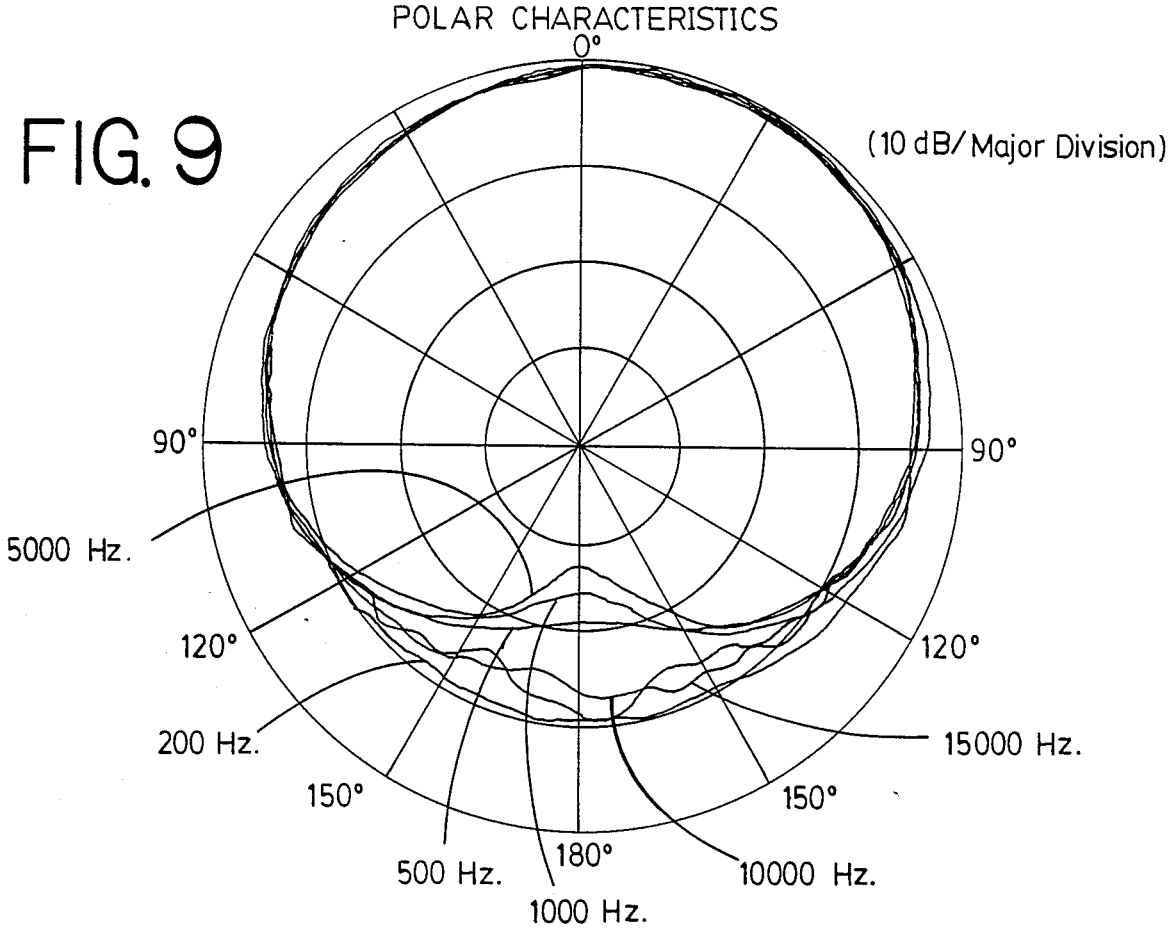
FIG. 9 is a chart of the polar characteristics of the microphone of FIGS. 1 through 4 above.
Figure 10:
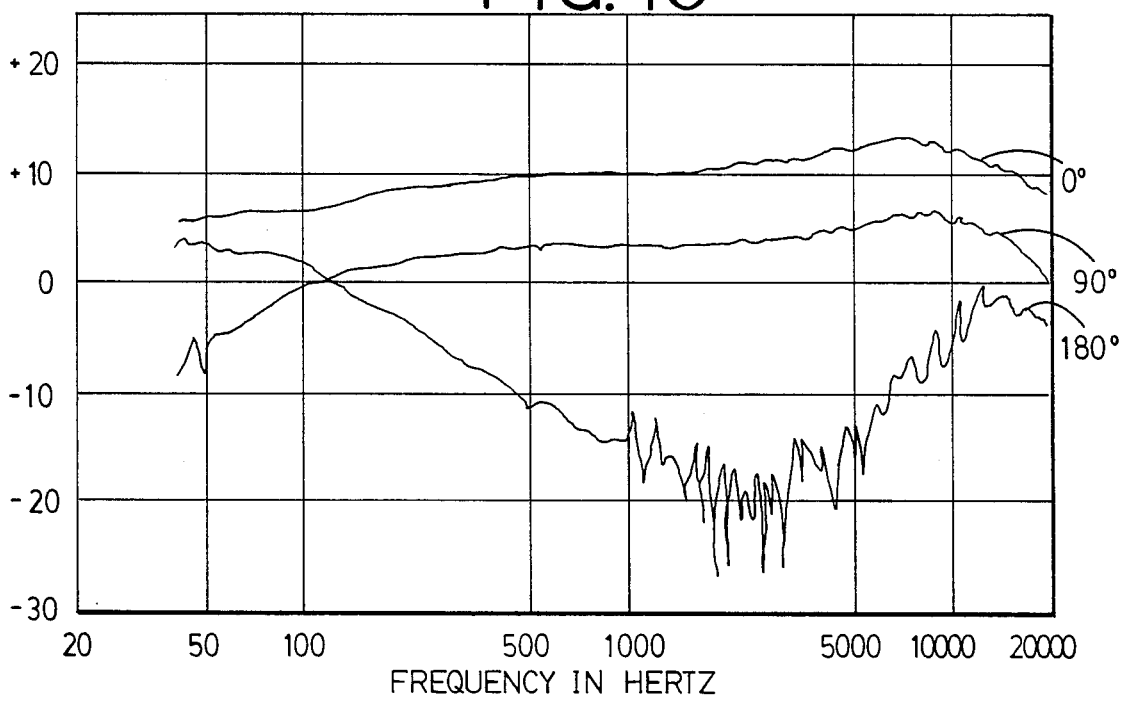
FIG. 10 is a chart of the frequency response of the microphone of FIGS. 1 through 4 above.

FIG. 7 reveals the supercardioid pattern of the microphone with converter. Frequencies of 4,000 Hz and 8,000 Hz chart the most predominant supercardioid patterns. As shown in FIGS. 7 and 8, the microphone with converter experiences two nulls at approximately 125° from the principal axis. The nulls are most noticeable at higher frequencies.

Referring again to FIGS. 1 through 6, the body 16 of the converter 10 is a "gist" of the converter 10. The body 16 is the element of the converter 10 which provides the acoustic polar pattern conversion just described.

Figure 5:
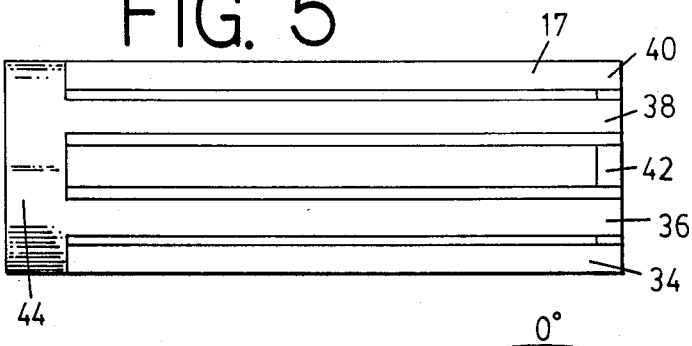
FIG. 5 is a side elevation view of a front support of the preferred embodiment as in FIG. 4.
Figure 6:
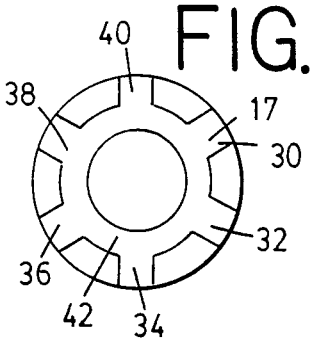
FIG. 6 is an end elevation view of a front support of the preferred embodiment as in FIG. 4.

The body 16 is, in part, press fittable on the microphone head 14 as stated. The body 16 is also held to the microphone head 14 by the supports 17, and 18. The body 16 slides within a cage of the front support 17. Referring to FIGS. 5 and 6, the cage is formed of a plurality of axially elongated, cross-sectionally square, circumferentially spaced ribs 30, 32, 34, 36, 38, and 40. The ribs are joined to a forward ring 42 and a rearward tube 44 in a single structure preferably of Lexan (TM).

The tube 44 of the front support 17 includes a lip 46, shown in FIG. 4. The lip 36 enters a groove 48 on the rear support 18, to attach to the rear support 18. The rear support 18 slips and clips over the microphone head 14. The foam cover 12 slips over the supports 17 and 18 for aesthetics, and to cushion inadvertent impacts against the converter 10.

The preferred embodiment and the invention are now described in such full, clear, concise, and exact terms as to enable a person of skill in the art to make and use the same. To particularly point out and distinctly claim the subject matter regarded as invention, the following claims conclude this specifications.

What is claimed is:

1. A microphone apparatus comprising a microphone having a microphone element with an acoustical polar pattern which is substantially cardioid about a principal axis, and an acoustical polar pattern converter including a converter body with an annular body portion having a plurality of ports, the convertor attached to the microphone with the converter body proximate to the microphone element and the angular body portion aligned along the principle axis, the converter causing the acoustical polar pattern of the microphone to be substantially supercardioid about the principle axis;

the annular body portion formed of an open pore material, said open pore material being porous plastic with a pore size of approximately 70 microns, the pores of the open pore material being the ports of said annular body portion;

said annular body portion defining a central cavity within said annular body portion, the central cavity extending along and centered on the principle axis of the microphone; and the converter having an end cap, the end cap closing the converter body remote from the microphone element.

2. Microphone apparatus of claim 1, the annular body portion have a wall thickness of approximately 0.05 inches.

3. Microphone apparatus as in claim 1, the converter causing the substantially supercardioid acoustical polar pattern to have nulls at approximately 125° from the principal axis.

4. Microphone apparatus as in claim 1, the annular body portion being fittable on the microphone.

* * * * *